US005830259A

United States Patent [19]

Kim et al.

[11] Patent Number: 5,830,259

[45] Date of Patent: Nov. 3, 1998

[54] PREVENTING SKULL ACCUMULATION ON A STEELMAKING LANCE

[75] Inventors: Chung S. Kim, Hudson, Ohio; Ken M. Goodson, Hammond, Ind.

[73] Assignee: LTV Steel Company, Inc., Cleveland, Ohio

[21] Appl. No.: 670,125

[22] Filed: Jun. 25, 1996

[51] Int. Cl.[6] ..... C21B 15/00

[52] U.S. Cl. ..... 75/502; 75/516; 266/44; 266/225

[58] Field of Search ..... 75/501, 503, 507, 75/502, 516; 266/44, 225; 134/2, 19, 22.11, 22.12, 22.18, 24, 25.4

[56] References Cited

U.S. PATENT DOCUMENTS

| | | |
|---|---|---|
| 613,598 | 2/1898 | Lilliequist et al. . |
| 3,320,053 | 5/1967 | Lehman . |
| 3,488,044 | 1/1970 | Shepherd . |
| 3,594,155 | 7/1971 | Ramachandran . |
| 3,620,455 | 11/1971 | Berry . |
| 3,653,877 | 4/1972 | Enya . |
| 3,700,429 | 10/1972 | Ramachandran . |
| 3,754,892 | 8/1973 | Ando et al. . |
| 3,861,888 | 1/1975 | Heise et al. . |
| 3,932,172 | 1/1976 | Knuppel et al. . |
| 3,941,623 | 3/1976 | Takashina et al. . |
| 3,953,199 | 4/1976 | Michaelis . |
| 3,955,964 | 5/1976 | MacDonald et al. . |

(List continued on next page.)

FOREIGN PATENT DOCUMENTS

| | | |
|---|---|---|
| 876526 | 7/1971 | Canada . |
| 0423098 | 10/1989 | European Pat. Off. . |
| 2433217 | 1/1975 | Germany . |
| 3231867 | 3/1984 | Germany . |
| 51-12320 | 1/1976 | Japan . |
| 61-139616 | 12/1984 | Japan . |
| 6-25732 | 2/1994 | Japan . |
| 414312 | 3/1972 | U.S.S.R. . |
| 502950 | 7/1972 | U.S.S.R. . |
| 499315 | 4/1973 | U.S.S.R. . |
| 1395682 | 4/1986 | U.S.S.R. . |
| 1190137 | 4/1970 | United Kingdom . |

OTHER PUBLICATIONS

Soejima et al. "Post Combustion in 240T Combined Blowing Converter", presented at the 110$^{th}$ ISIJ Meeting, Lecture No. S1042, B–166(Oct. 1985).

"BOF Slopping Control", Steelmaking Proceedings, vol. 62, 1979, authored by R.G. Blossey, C.S. Kim and J.D. Shimkets, pp. 158–163.

"Investigation of the Effect on Post Combustion in LD Converter", Transactions ISU, vol. 25, 1985.

"Operating Results Using Post–Combustion Lances At The Bethlehem, PA, BOF Shop", authored by John J. Repasch et al., pp. 225–235, 1995 Steelmaking Conference Proceedings.

Kawasaki Steel Technical Report No. 12, Jul. 1995, "Production of Deep Drawing Quality Steel Sheets for Porcelain Enameling by Continuous Casting", pp. 45–54.

*Primary Examiner*—Jeffrey Stucker

*Attorney, Agent, or Firm*—Watts, Hoffmann, Fisher & Heinke Co. L.P.A.

[57] ABSTRACT

A self-cleaning lance includes a lance body elongated along a longitudinal axis and having an upper end portion and a lower end portion, the lower end portion being spaced apart from the upper end portion along the longitudinal axis. One or more main nozzles are located proximal to the lower end portion and are adapted to release an oxygen-containing gas. One or more deskulling nozzles are spaced upwardly from the lower end portion and are adapted to release a deskulling gas. The lance body has a first portion that extends axially from the deskulling nozzles to the main nozzles and a second portion above the deskulling nozzles. The first portion has a smaller outer perimeter than the outer perimeter of the second portion. Each of the deskulling nozzles extends by an angle of not greater than 25 degrees with respect to the longitudinal axis.

30 Claims, 2 Drawing Sheets

U.S. PATENT DOCUMENTS

| | | | |
|---|---|---|---|
| 4,004,920 | 1/1977 | Fruehan . | |
| 4,081,270 | 3/1978 | Tichauer et al. . | |
| 4,230,274 | 10/1980 | Rymarchyk et al. . | |
| 4,270,949 | 6/1981 | Esposito et al. . | |
| 4,322,033 | 3/1982 | Rymarchyk et al. . | |
| 4,348,229 | 9/1982 | Suemura et al. . | |
| 4,405,365 | 9/1983 | Robert . | |
| 4,427,186 | 1/1984 | Buhrmann . | |
| 4,434,005 | 2/1984 | Metz et al. . | |
| 4,490,172 | 12/1984 | Moore et al. . | |
| 4,533,124 | 8/1985 | Mercatoris . | |
| 4,564,390 | 1/1986 | Gupta et al. . | |
| 4,615,730 | 10/1986 | Tommaney . | |
| 4,643,403 | 2/1987 | Buhrmann et al. . | |
| 4,653,730 | 3/1987 | Wunsche et al. . | |
| 4,746,103 | 5/1988 | Takashiba et al. . | |
| 4,971,297 | 11/1990 | Henrion et al. . | |
| 4,979,997 | 12/1990 | Kobayashi et al. . | |
| 4,988,079 | 1/1991 | Takahashi et al. . | |
| 5,045,129 | 9/1991 | Barisoni . | |
| 5,062,905 | 11/1991 | Tomita et al. . | |
| 5,088,696 | 2/1992 | Desaar . | |
| 5,145,533 | 9/1992 | Yoshitomi et al. . | |
| 5,251,879 | 10/1993 | Floyd . | |
| 5,298,053 | 3/1994 | Griffing . | |
| 5,303,901 | 4/1994 | Bock et al. | 266/225 |
| 5,377,960 | 1/1995 | Leczo et al. | 266/225 |
| 5,417,739 | 5/1995 | Watkins et al. . | |

PREVENTING SKULL ACCUMULATION ON A STEELMAKING LANCE

FIELD OF THE INVENTION

This invention relates to preventing skulling of lances used in the process of making steel and, in particular, to preventing skulling of oxygen-blowing refining lances used to make steel in a basic oxygen furnace.

BACKGROUND OF THE INVENTION

One of the reactions that occurs during the steelmaking process in a basic oxygen furnace ("hereinafter BOF") is the reaction of oxygen blown by a lance with carbon from the melt. This reaction releases a significant portion of the carbon-oxygen reaction product as carbon monoxide gas. Carbon monoxide gas is generated at different rates throughout the refining process. At the onset of a typical heat, little carbon monoxide gas is generated. During the middle of the heat, carbon monoxide gas is generated at a maximum rate. At the end of the heat, as the amount of carbon in the melt decreases, the rate of carbon monoxide generation also decreases to a minimum rate.

Attempts have been made to commercialize a process known as "post combustion" in which the carbon monoxide gas is reacted with post combustion oxygen blown from a lance. Since relatively little carbon monoxide gas is generated at the beginning and at the end of a heat during refining, the amount of post combustion oxygen gas that is blown at these times for reaction with the carbon monoxide gas is either reduced or eliminated. By blowing the post combustion oxygen especially during the beginning and end of the heat, the refractory vessel lining may be eroded.

During the refining process, enormous heat is generated by the oxygen reacting with the carbon in the melt and to a certain extent the oxygen reacting with the iron in the melt. Oxygen gas that penetrates the melt at a high velocity and the reaction that releases the carbon monoxide gas, result in vigorous agitation of the bath. Due to the violent agitation of the melt, a material commonly known as skull, which is a mixture of molten metal and oxides, is deposited on the working surface of the furnace and on the lances. Skull that contacts a water cooled lance will solidify on it and adhere to it. Skull that has accumulated on the refining lance is undesirable and must be removed, since it increases the weight of the lance and may clog its nozzles. The greater the adhesiveness of skull on the lance, the more difficult it is to remove.

The rate at which skull accumulates on a lance is converse to the rate at which carbon monoxide is generated during refining. During the middle of the heat when carbon monoxide generation is greatest, little skull will accumulate on the lance because the furnace is hottest at this time and skull only weakly adheres to the lance. Skull accumulation is greatest at the beginning and end of a heat. The absence of slag at the beginning of the heat and the condition of the slag at the end of the heat each leads to "sparking" of the metal in the furnace. As a result, skull comprising mostly molten metal contacts the lance and strongly adheres to it.

Removing skull from a lance is a time consuming and costly process. At a typical BOF shop three workers may be employed full time to clean skull build-up from the refining lances. The workers may first attempt to remove the skull from the lances by striking the skull with a metal rod. This technique may become ineffective as more skull accumulates on the lance. Therefore, the workers may cut the skull from the lance using a torch.

Conventional cleaning practices have numerous disadvantages. Cleaning the lances is hazardous since the workers are located above the mouth of the BOF during the cleaning process. Cleaning the lance with a torch is especially dangerous. In addition, workers occasionally inadvertently burn the lance with the torch. Moreover, cleaning the lances is time consuming and costly. The cleaning process usually lasts a couple of hours, which exceeds the time between heats. Rather than clean the lance while it is above the BOF, workers may replace the skulled lance with an unskulled lance. However, it takes about an hour to replace lances. The delay involved in cleaning and replacing lances may be more tolerable in shops that employ more than one BOF. However, the need to clean lances may result in unscheduled transfers of heats to another BOF. Any delay in conducting heats ultimately reduces the efficiency of the BOF and thus, is undesirable.

SUMMARY OF THE INVENTION

The present invention pertains to preventing the accumulation of skull on refining lances used to make steel in a basic oxygen furnace. The accumulation of substantially all skull is prevented on self-cleaning lances constructed in accordance with the invention. The present invention provides a substantial savings in the production of steel in a basic oxygen furnace. Since skull accumulation on the refining lance is substantially prevented, conventional lance cleaning processes requiring extensive time, manpower and equipment are not required in the method of the present invention. In addition, the furnaces are able to be operated at maximum efficiency. Furnace operation is not delayed or burdened by extensive lance cleaning processes or by unscheduled transfers of heats that result therefrom.

In general, the present invention pertains to preventing the accumulation of skull on a lance including a lance body elongated along a longitudinal axis and having an upper end portion and a lower end portion. Main nozzles are located proximal to the lower end portion and are adapted to release an oxygen-containing gas. Upper deskulling nozzles are spaced upwardly from the lower end portion along the longitudinal axis and are adapted to release a deskulling gas, which is preferably an oxygen-containing gas.

A first portion extends from the deskulling nozzles to the main nozzles and a second portion is disposed above the deskulling nozzles. The first portion has a smaller outer perimeter than an outer perimeter of the second portion. A transition from the first portion outer perimeter to the second portion outer perimeter forms a shoulder. In one embodiment, the shoulder may extend at an angle of 90 degrees with respect to the longitudinal axis.

In one aspect, the present invention may include at least one intermediate portion and deskulling nozzles disposed below the upper deskulling nozzles. The intermediate portion has an outer perimeter that is greater than the first portion outer perimeter and less than the second portion outer perimeter. Each of the deskulling nozzles preferably extends at an angle of not greater than 25 degrees with respect to the longitudinal axis and, more preferably, in the range of 5–25 degrees with respect to the longitudinal axis. Each of the deskulling nozzles may include a nozzle orifice that communicates with its associated shoulder. The shoulder has a width and each of the deskulling nozzles has an angle that avoids excessive heating of the lance while eliminating accumulation of substantially all skull on the lance.

The present invention effectively prevents skull accumulation even at the beginning and end of a heat when skull formation on lances is greatest. In the present invention, oxygen gas may be released continuously from the deskulling nozzles throughout the refining process without any danger of eroding the furnace lining. In contrast, post combustion oxygen is typically only blown intermittently, being reduced or turned off at the beginning and end of a heat, so as to avoid eroding the furnace lining.

A method of cleaning a steelmaking lance according to the present invention generally includes the step of releasing the deskulling gas from the deskulling nozzles. Heat is generated by reacting the deskulling gas with the carbon monoxide gas released from the bath. The heat is applied to preferably both the first and second lance portions to prevent accumulation of substantially all skull on the lance.

One aspect of the method of the present invention includes the step of releasing the deskulling gas from the deskulling nozzles along the first portion of the lance. The deskulling gas is reacted with the carbon monoxide gas released from the bath to generate heat. The heat is permitted to act on the lance to prevent accumulation of substantially all skull on the lance.

One aspect of the method includes releasing the deskulling gas from each of the deskulling nozzles at an angle not greater than 25 with respect to the longitudinal axis. The deskulling gas may be directed from the deskulling nozzles to blow skull from the lance. The heat is preferably permitted to act on both the first and second portions of the lance. The deskulling gas may be released throughout the entire steelmaking process.

Other embodiments of the invention are contemplated to provide particular features and structural variants of the basic elements. The specific embodiments referred to as well as possible variations and the various features and advantages of the invention will become better understood from the detailed description that follows, together in connection with the accompanying drawings.

DETAILED DESCRIPTION OF THE PREFERRED EMBODIMENTS

Figure 1:
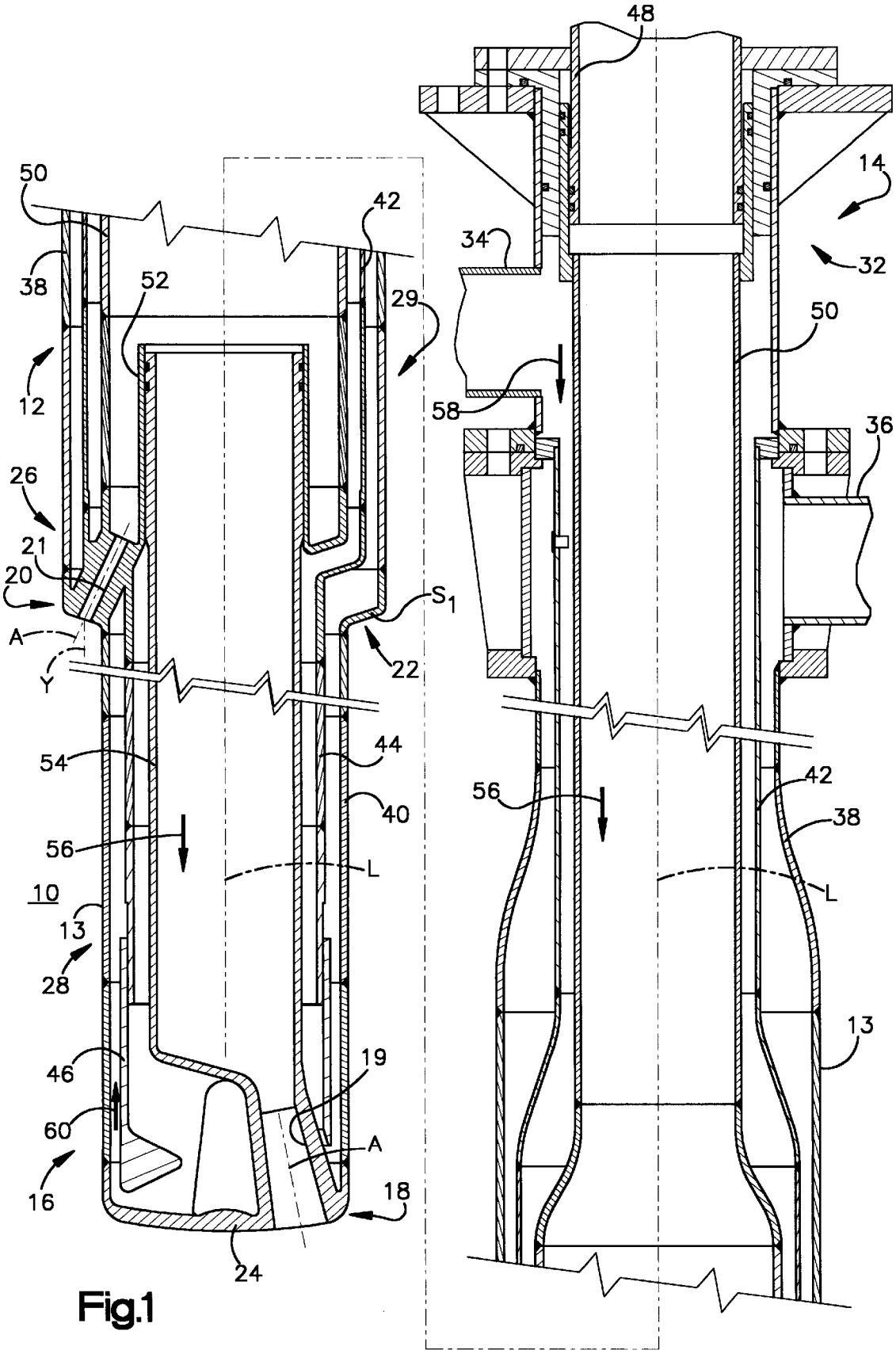
FIG. 1 is a vertical cross-sectional view of a lance assembly constructed in accordance with the present invention.

Turning now to the drawings, a self-cleaning refining lance assembly constructed according to the invention is shown generally at 10. The lance assembly 10 includes a lance body 12 with an outer surface 13. The body 12 is elongated along a longitudinal axis L and has an upper end portion 14 and a lower end portion 16. Main nozzles 18 include orifices 19 and are located proximal to the lower end portion 16. The main nozzles 18 are adapted to release an oxygen-containing gas for refining molten metal in a basic oxygen furnace. Upper deskulling nozzles 20 include orifices 21 and are spaced upwardly from the lower end portion 16. The deskulling nozzles 20 are adapted to release a deskulling gas for preventing the accumulation of skull on the outer lance surface 13. The lance assembly 10 also includes an upper stepped portion 22 to facilitate distributing the deskulling gas along the outer surface 13 to the main nozzles 18.

A tip 24 is preferably disposed at the lower end portion 16. A section 26, which will be referred to herein as a distributor section, is located distally from the lower end portion 16. That is, the distributor section 26 is spaced from the lower end portion 16 along the longitudinal axis L. The main nozzles 18 are located proximal to the lower end portion 16, preferably at the bottom of the lance in the tip 24.

The deskulling nozzles 20 are located distally from the lower end portion 16 in the distributor section 26. The deskulling nozzle orifices 21 of the distributor section 26 (only one of which is shown) are preferably circumferentially equally spaced about the longitudinal axis L. Any suitable number of main and deskulling nozzle orifices may be used in the lance of the present invention as will be apparent to those skilled in the art in view of this disclosure. In preferred form, the lance of the present invention includes 3–5 main nozzle orifices and 8–14 deskulling nozzle orifices.

Figure 2:
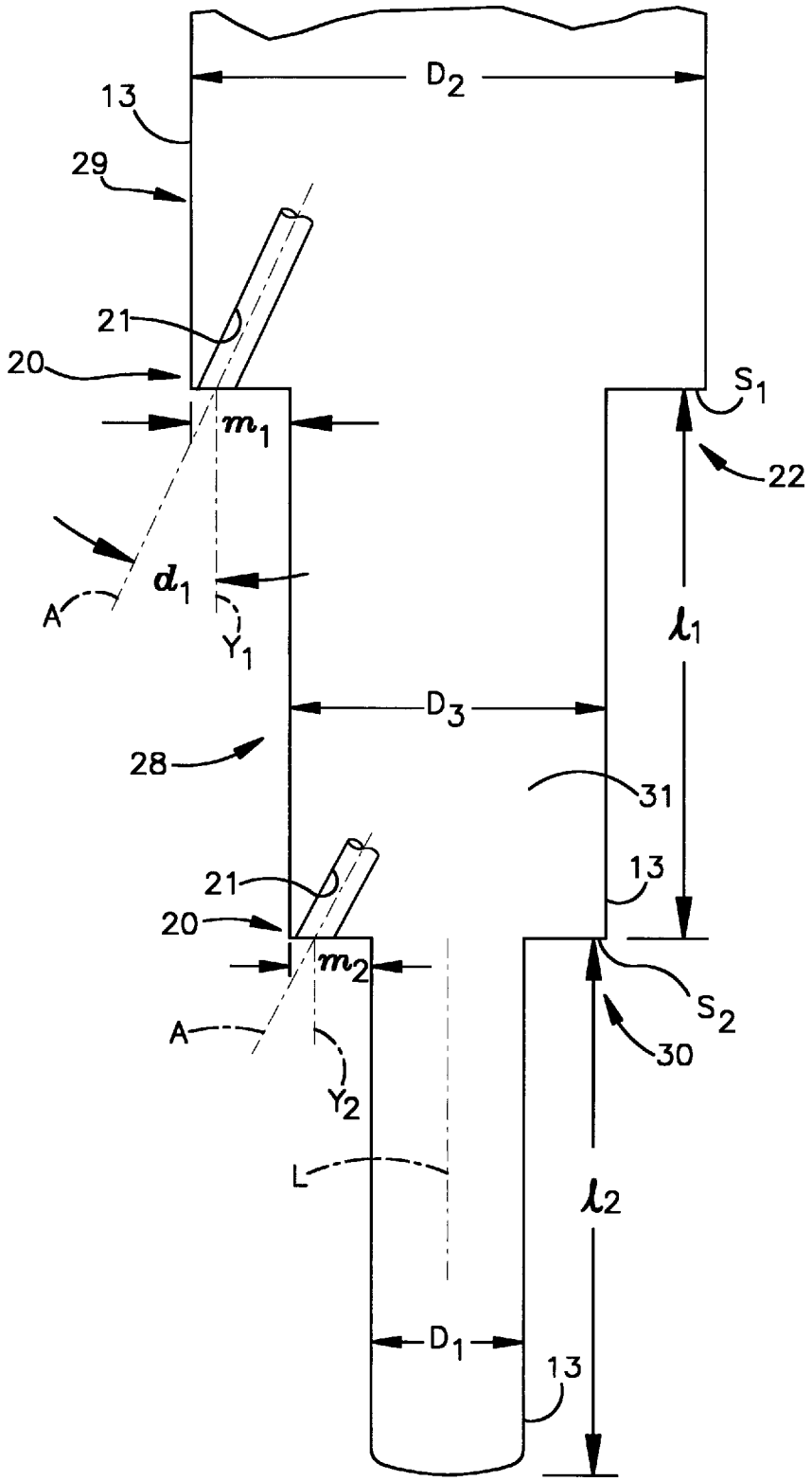
FIG. 2 is a schematic view relating to one embodiment of the lance assembly of FIG. 1.

The deskulling nozzle orifices 21 diverge radially outwardly from the longitudinal axis L. Each of the nozzle orifices 19, 21 extends along an associated axis A. All of the deskulling nozzle orifices of the present invention extend at an angle $\alpha$ with respect to an associated generally vertical axis y, which is parallel to the longitudinal axis L (FIG. 2). An oxygen-containing gas is preferably used as the deskulling gas. However, any gas that reacts with carbon monoxide gas to generate heat may be suitable for use in the present invention.

The upper stepped portion 22 of the lance body 12 is defined by a first portion 28, a second portion 29 and a shoulder $S_1$. As shown in FIGS. 1 and 2, the first portion 28 has a smaller outer diameter $D_1$ than the outer diameter $D_2$ of the second portion 29. A transition from the first portion outer diameter $D_1$ to the second portion outer diameter $D_2$ forms the shoulder $S_1$. The first portion 28 extends axially from the upper deskulling nozzles 20 all the way to the main nozzles 18. The second portion 29 is located above and adjacent the upper deskulling nozzles 20. The second portion 29 may extend axially upwardly a few feet from the deskulling nozzles 20.

The lance body 12 may include at least one intermediate stepped portion 30 between the upper stepped portion 22 and the lower end portion 16. In FIG. 2, an intermediate lance portion 31 has an outer diameter $D_3$ that is greater than the first portion outer diameter $D_1$ and less than the second portion outer diameter $D_2$. The intermediate portion 31 is disposed along the first portion 28. The transition between the first portion outer diameter $D_1$ and the intermediate portion outer diameter $D_3$ forms a shoulder $S_2$. The intermediate stepped portion 31 includes deskulling nozzles 21.

The length of the intermediate portion 31 between the shoulder $S_1$ and the shoulder $S_2$ is $1_1$. The length between the shoulder $S_2$ and the lowermost portion of the lance is 12. The shoulder $S_1$ has a width $m_1$. The width of the shoulder $S_2$ is $m_2$.

In a lance shown in FIG. 1 having only one stepped portion, the upper stepped portion 22 facilitates the flow of deskulling oxygen gas down the lance to the main nozzles 18. Since the first portion 28 has a smaller diameter than the second portion 29, the deskulling oxygen gas may flow downwardly along the entire length of the first portion 28. The deskulling nozzles 20 may extend into direct communication with their associated shoulder in the manner shown in FIG. 2. This also facilitates flowing the deskulling oxygen gas along the length of the lance first portion 28. By flowing the deskulling oxygen gas down the entire length of the first portion 28, the entire first portion of the lance may be maintained skull-free.

A predetermined shoulder-to-angle relationship is established in the present invention between the secondary nozzle angle α and the shoulder width m. This relationship is defined herein as that which avoids excessive heating of the lance body 12 while preventing accumulation of substantially all skull on the lance body 12. Heating of the lance body is excessive if, as a result, "scarfing" occurs, i.e., the lance is burned or deteriorated. The shoulder-to-angle relationship may be influenced by other factors such as the number, location and size of the deskulling nozzles, the concentration of oxygen in the deskulling gas, the flow rate and velocity of the deskulling gas, the number of stepped portions, and the magnitude of the lengths $l_1$ and $l_2$. For example, at deskulling nozzle angles α of 25 degrees compared to deskulling nozzle angles α of 5 degrees, the flow rate must be nearly doubled to enable the lance to be substantially skull-free.

The angles α and the shoulder widths m may have any values that satisfy the shoulder-to-angle relationship of the present invention. The deskulling nozzle angle α and shoulder width m may vary from one stepped portion to another. Shoulder widths may range, for example, from about ½–2 inches and, in particular, from 1–2 inches, with about 1 inch being preferred. The deskulling nozzle angle α must not be greater than 25 degrees to heat the lance in the most effective manner and to avoid eroding the refractory furnace lining. More preferably, the deskulling nozzle orifices 21 extend by an angle in the range of from about 5–25 degrees with respect to the longitudinal axis and, in particular, in the range of from about 16–25 degrees from the longitudinal axis.

If a longer shoulder width m is desired, the angle α may be made more acute. Conversely, if a shorter shoulder width m is desired, the angle α may be increased. Shoulder widths should not be of a size that increases the weight of the lance excessively or otherwise exceeds design constraints. As shown in FIG. 2, the shoulders may be square with respect to their associated axis y, i.e., they may extend at an angle of 90 degrees with respect thereto. The shoulders may also be inclined with respect to the associated axis y as shown in FIG. 1. By constructing the lance with angles α and shoulder widths m that satisfy the shoulder-to-angle relationship and by operating the lance according to the other parameters of the present invention, substantially no skull will accumulate on the lance first portion, and lance "scarfing" and furnace erosion will be avoided.

A housing assembly 32 is disposed at the upper end portion 14, and may have any structure known to those skilled in the art. The housing assembly 32 is supported by a lance carriage (not shown) in a manner known to those skilled in the art in view of this disclosure. A coolant supply pipe 34 and a coolant return pipe 36 are each connected to an associated opening in the housing assembly 32. An upper radially outer pipe 38 is welded to the housing assembly 32. The lower end of the outer pipe 38 is welded to an upper annular portion of the distributor section 26.

A lower radially outermost pipe 40 is welded at its upper end to a lower radially outermost annular portion of the distributor section 26. The lower end of the pipe 40 is welded to an upper radially outermost annular portion of the tip 24. The upper end of the pipe 40 and the lower end of the pipe 38 are connected by the shoulder $S_1$.

Spaced inwardly of and concentric with the pipe 38 is an upper radially intermediate pipe 42 connected at its upper end to the housing assembly 32. At its lower end the intermediate pipe 42 is welded to the distributor section 26. A lower radially intermediate pipe 44 is spaced inwardly of and concentric to the pipe 40. The upper end of the pipe 44 is welded to the distributor section 26. The lower end of the pipe 44 engages a sleeve 46 that is welded to a radially intermediate annular portion of the tip 24.

A gas inlet pipe 48 is disposed at the upper end of the housing assembly 32 and extends upwardly therefrom where it is connected to a gas source in a manner known to those skilled in the art in view of this disclosure. An upper radially innermost pipe 50 is spaced inwardly of and concentric to the pipe 42. The pipe 50 is connected to the housing assembly 32 in fluid communication with the gas inlet pipe 48.

The lower end of the pipe 50 is welded to an upper annular portion of the distributor section 26. A sleeve 52 extends upwardly from the upper radially innermost portion of the distributor section 26. Interior of and concentric to the lower intermediate pipe 44 is a lower radially innermost pipe 54. The upper end of the pipe 54 engages the sleeve 52. The lower end of the pipe 54 is connected to the radially innermost annular portion of the tip 24.

A main gas flow passageway 56 is defined by portions of the lance including the gas inlet pipe 48, the pipe 50 and the pipe 54. The passageway 56 provides both the main nozzles 18 and the deskulling nozzles 20 with a single flow of pressurized gas through the lance. The gas flows from the gas source to the gas inlet pipe 48 and through the passageway 56.

A coolant intake passageway 58 and a coolant outlet passageway 60 are defined by the lance assembly 10 as shown in FIG. 1. A coolant such as water is introduced from a coolant supply (not shown) through the coolant intake passageway 58 and into the tip 24, through the coolant outlet passageway 60 and back to the coolant supply.

The single circuit lance assembly 10 that is shown in FIG. 1 is only one example of a lance assembly suitable for carrying out the present invention. The present invention may also be employed in other refining lance designs such as a double circuit lance assembly, which is well known to those skilled in the art. For a description of an example of single and double circuit oxygen blowing lance designs, see U.S. Pat. No. 3,620,455, which is incorporated herein by reference in its entirety. In a double circuit lance constructed to include the features of the present invention, the deskulling nozzles 20 would be in fluid communication with an deskulling fluid passageway. The main gas flow passageway 56 would lead only to the main nozzles 18 and would be isolated from fluid communication with the deskulling fluid passageway and the deskulling nozzles 20. Gas flow through the deskulling nozzles 20 would be able to be regulated independently of gas flow through the main nozzles 18.

In operation in both the single and double circuit designs, oxygen gas is blown down the main passageway 56 to the main nozzles 18. The deskulling gas is blown through the deskulling nozzle orifices 21 continuously from the beginning to the end of the refining process. The deskulling gas is directed by the deskulling nozzle orifices 21 where it travels along the first portion 28 all the way to the main nozzles 18.

The following provides exemplary design criteria of the lance assembly 10. The self-cleaning refining lance 10 may be any suitable length, for example, approximately 78 feet in length. The lance typically extends about 18 feet into the furnace and is constructed of steel. The deskulling nozzles 20 of the upper stepped portion 22 are spaced a suitable distance upwardly from the lowermost portion of the lance to prevent substantially all skull accumulation on the lance. To this end, the deskulling nozzles are preferably spaced 6 or 8 feet from the lowermost portion of the lance. The pipes of the lance may range from 6 to 14 inches in diameter, for example. As an example, the upper radially outermost pipe 38 of the second portion 29 may be 14 inches in diameter and the lower radially outermost pipe 40 of the first portion 28 may be 10 inches in diameter. This results in a shoulder that is 2 inches wide. The nozzle orifices in the deskulling section and in the tip may be any suitable diameter. For example, the deskulling nozzle orifices may be about ½ inch in diameter and the main nozzle orifices may be about 2 inches in diameter.

One or more of the intermediate stepped portions 30 may be employed below the upper stepped portion 22 in certain circumstances including when a BOF has a sparking problem caused by the particular thermodynamics or chemistry of heats in that furnace, when the deskulling nozzles are located more than about 8 feet from the bottom of the lance or when wide deskulling nozzle angles or low flow rates are used.

The following provides exemplary operating conditions for a lance that employs the features of the present invention. For both single and double circuit lances, the flow rate through the deskulling nozzle orifices 20 is in the range of from about 500–1500 SCFM. At an deskulling nozzle angle of 5 degrees a flow rate of 500 SCFM may be used, while at an deskulling nozzle angle of 25 degrees a flow rate of at least about 1000 SCFM may be required. In single circuit lances the deskulling oxygen gas is blown at a velocity of about mach 1, while in double circuit lances the deskulling oxygen gas is blown at a velocity in the range of from about mach 0.1–1.0.

In one particular example, a single circuit lance constructed according to the invention had 10 deskulling nozzles spaced 6 feet from the lowermost portion of the lance that each extended at 18 degrees with respect to their associated vertical axes. The deskulling gas flow capacity of the lance was rated at 500 SCFM. During a 5 day trial wherein 96 heats were conducted, substantially all skull accumulation on the lance was prevented.

While not wanting to be bound by theory, it is believed that skull accumulation on the lance is prevented primarily by two mechanisms, fluid flow (blowing of the deskulling oxygen gas along the lance at a relatively high velocity and flow rate) and heating the outside surface of the lance. In view of the relatively high velocity and flow rate of deskulling oxygen gas, the deskulling oxygen gas may physically blow from the lance any skull that is deposited on its first portion 28. Since the second lance portion 29 is disposed above the upper deskulling nozzles 20, skull accumulation there is unaffected by the fluid flow mechanism.

The carbon monoxide gas released from the melt reacts with the deskulling oxygen released from the lance, which generates heat. The heat released from this reaction forms heat that is permitted to act upon the outer surface 13 of both the first and second portions of the lance. The outer surface 13 of the lance is heated to a temperature at which the bonding between the skull and the lance is weakened. The outer surface 13 may be heated to a lower temperature in the second portion 29 than in the first portion 28. Skull that forms on the first portion of the heated lance adheres to it very weakly and movement of the lance causes the skull to drop off the lance.

Skull that forms on the second portion above the deskulling nozzles 20 also adheres there weakly, although somewhat stronger than in the first portion. Therefore, some skull may temporarily accumulate on the second portion 29 while it is in the furnace. In this event, hitting the lance with a rod as the lance is raised from the furnace easily removes any accumulation of skull from the second portion 29. Skull is removed quickly and easily from the second portion 29 without delaying the operation of the furnace.

Although the invention has been described in its preferred form with a certain degree of particularity, it will be understood that the present disclosure of the preferred embodiments has been made only by way of example and that various changes may be resorted to without departing from the true spirit and scope of the invention as hereafter claimed.

What is claimed is:

1. A self-cleaning steelmaking lance that prevents accumulation of skull on said lance when said lance is used in a steelmaking vessel, said lance comprising:

a lance body elongated along a longitudinal axis and having an upper end portion and a lower end portion, at least one main nozzle each located proximal to the lower end portion and extending along a main nozzle axis, the at least one said main nozzle being adapted to release an oxygen-containing gas, at least one upper deskulling nozzle each extending along an upper deskulling nozzle axis and spaced upwardly from the at least one said main nozzle along the longitudinal axis, said lance body having a first portion that extends axially between the at least one said upper deskulling nozzle and the at least one said main nozzle and said lance body having a second portion above the at least one said upper deskulling nozzle said first portion having a smaller outer perimeter than the outer perimeter of said second portion, and at least one lower deskulling nozzle each disposed below the at least one said upper deskulling nozzle and extending along a lower deskulling nozzle axis, said lance body further including at least one intermediate portion disposed between the at least one said upper deskulling nozzle and the at least one said lower deskulling nozzle, said intermediate portion having an outer perimeter that is greater than the first portion outer perimeter and less than the second portion outer perimeter, wherein said upper and lower deskulling nozzles extend at an angle not greater than 25 degrees with respect to the longitudinal axis, wherein a transition between the first portion outer perimeter and the intermediate portion outer perimeter forms a first shoulder and a transition between the intermediate portion outer perimeter and the second portion outer perimeter forms a second shoulder and the at least one said upper deskulling nozzle communicates with said second shoulder and the at least one said lower deskulling nozzle communicates with said first shoulder.

2. The self-cleaning lance of claim 1 wherein each of said first shoulder and said second shoulder extends at an angle of 90 degrees with respect to the longitudinal axis.

3. The lance of claim 1 wherein a diameter of each of the at least one said upper deskulling nozzle and a diameter of the at least one said lower deskulling nozzle are each not more than about 25% of a diameter of the at least one said main nozzle transverse to the main nozzle axis.

4. The lance of claim 3 wherein the diameter of the at least one said upper deskulling nozzle, the diameter of the at least one said lower deskulling nozzle and the diameter of the at least one said main nozzle are taken at an exterior surface of said lance.

5. A method of operating a steelmaking lance in a self-cleaning manner, comprising the steps of positioning the lance in a steelmaking vessel, flowing a deskulling gas to at least one deskulling nozzle spaced upwardly from at least one main nozzle along a longitudinal axis of said lance, each said main nozzle being disposed near a lower end portion of said lance and extending along a main nozzle axis and each said deskulling nozzle extending along a deskulling nozzle axis, directing said deskulling gas from the at least one said deskulling nozzle along the deskulling nozzle axis at an angle not greater than 25 degrees with respect to the longitudinal axis, and regulating flow of said deskulling gas in a manner effective to prevent accumulation of substantially all skull on said lance and to prevent excessive heating of said lance.

6. The method of claim 5 comprising directing said gas from said deskulling nozzles to blow skull from said lance.

7. The method of claim 5 comprising releasing said deskulling gas throughout an entire steelmaking process.

8. The method of claim 5 wherein said deskulling gas is an oxygen-containing gas.

9. The method of claim 5 comprising releasing said deskulling gas at a flow rate not greater than 1500 standard cubic feet per minute.

10. The method of claim 5 comprising flowing an oxygen-containing gas from the at least one said main nozzle.

11. The method of claim 5 comprising releasing said deskulling gas at a beginning portion and at an end portion of a steelmaking heat at flow rates which are not substantially less than a flow rate at which said deskulling gas is released during a peak decarburization period of the heat.

12. The method of claim 5 wherein said deskulling gas is directed through the at least one said deskulling nozzle having a diameter which is not greater than about 25% of a diameter of the at least one said main nozzle.

13. The method of claim 5 comprising flowing an oxygen-containing gas to the at least one said deskulling nozzle and to the at least one said main nozzle along a single fluid passageway.

14. The method of claim 5 comprising flowing said deskulling gas to the at least one said deskulling nozzle along a first fluid passageway and flowing an oxygen-containing gas to the at least one said main nozzle along a second fluid passageway, wherein said first passageway is isolated from fluid communication with said second passageway.

15. The method of claim 5 comprising regulating flow of said deskulling gas from the at least one said deskulling nozzle to a velocity ranging from about Mach 0.1 to about Mach 1.0.

16. A self-cleaning steelmaking lance that prevents accumulation of skull on said lance when said lance is used in a steelmaking vessel, said lance comprising:

a lance body elongated along a longitudinal axis and having an upper end portion and a lower end portion, at least one main nozzle each located proximal to the lower end portion and extending along a main nozzle axis, the at least one said main nozzle releasing an oxygen-containing gas, and at least one deskulling nozzle that releases a deskulling gas, each said deskulling nozzle extending along a deskulling nozzle axis and being spaced upwardly from the at least one said main nozzle along the longitudinal axis, said lance body having a first portion that extends axially between the at least one said deskulling nozzle and the at least one said main nozzle and said lance body having a second portion above the at least one said deskulling nozzle, said first portion having a smaller outer perimeter than an outer perimeter of said second portion, wherein each said deskulling nozzle extends along the deskulling nozzle axis at an angle not greater than 25 degrees with respect to the longitudinal axis, and wherein a diameter of the at least one said deskulling nozzle is not more than about 25% of a diameter of the at least one said main nozzle.

17. The self-cleaning lance of claim 16 wherein each said deskulling nozzle releases an oxygen-containing gas.

18. The lance of claim 16 comprising a single passageway in fluid communication with both the at least one said deskulling nozzle and the at least one said main nozzle.

19. The lance of claim 16 comprising a first fluid passageway in fluid communication with the at least one said deskulling nozzle and a second fluid passageway in fluid communication with the at least one said main nozzle, said first passageway being isolated from fluid communication with said second passageway.

20. The lance of claim 16 wherein the diameter of the at least one said deskulling nozzle is not greater than about ½ inch.

21. The lance of claim 16 wherein a transition between the first portion outer perimeter and the second portion outer perimeter forms a shoulder and the at least one said deskulling nozzle communicates with said shoulder each at a discharge location spaced from said first portion transverse to the longitudinal axis.

22. The self-cleaning lance of claim 21 wherein said shoulder has a width ranging from about ½–2 inches.

23. The self-cleaning lance of claim 21 wherein said shoulder extends at an angle of 90 degrees with respect to the longitudinal axis.

24. The lance of claim 16 wherein the diameter of the at least one said deskulling nozzle and the diameter of the at least one said main nozzle are taken at an exterior surface of said lance.

25. A method of operating a steelmaking lance in a self-cleaning manner, comprising the steps of positioning the lance in a steelmaking vessel, flowing a deskulling gas to at least one deskulling nozzle spaced upwardly from at least one main nozzle along a longitudinal axis of said lance, each said main nozzle being disposed near a lower end portion of said lance and extending along a main nozzle axis and each said deskulling nozzle extending along a deskulling nozzle axis, said lance body having a first portion that extends axially between the at least one said deskulling nozzle and the at least one said main nozzle and said lance body having a second portion above the at least one said deskulling nozzle, said first portion having a smaller outer perimeter than an outer perimeter of said second portion, directing said deskulling gas from the at least one said deskulling nozzle along the deskulling nozzle axis at an angle not greater than 25 degrees with respect to the longitudinal axis, and regulating flow of said deskulling gas to be at a flow rate that is not greater than about 1500 standard cubic feet per minute during an entire steelmaking process to prevent accumulation of substantially all skull on said lance and to prevent excessive heating of said lance.

26. The method of claim 25 wherein said deskulling gas is directed through the at least one said deskulling nozzle having a diameter which is not greater than about 25% of a diameter of the at least one said main nozzle.

27. The method of claim 25 comprising flowing an oxygen-containing gas to the at least one said deskulling nozzle and to the at least one said main nozzle along a single fluid passageway.

28. The method of claim 25 comprising flowing said deskulling gas to the at least one said deskulling nozzle along a first fluid passageway and flowing an oxygen-containing gas to the at least one said main nozzle along a second fluid passageway, wherein said first passageway is isolated from fluid communication with said second passageway.

29. The method of claim 25 comprising regulating flow of said deskulling gas from the at least one said deskulling nozzle to a velocity not greater than about Mach 1.0.

30. The method of claim 29 wherein said velocity ranges from about Mach 0.1 to about Mach 1.0.

* * * * *